US010665930B2

(12) United States Patent
Joo et al.

(10) Patent No.: US 10,665,930 B2
(45) Date of Patent: May 26, 2020

(54) TILE STRUCTURE OF SHAPE-ADAPTIVE PHASED ARRAY ANTENNA

(71) Applicant: AGENCY FOR DEFENSE DEVELOPMENT, Daejeon (KR)

(72) Inventors: Tae Hwan Joo, Daejeon (KR); Jong Woo Seo, Daejeon (KR); Ji Ho Ryu, Daejeon (KR); Ki Chul Kim, Sejong-si (KR); Chan Ho Hwang, Daejeon (KR); Min Sung Kim, Daejeon (KR); Cheol Hoon Lee, Geumsan-gun (KR)

(73) Assignee: AGENCY FOR DEFENSE DEVELOPMENT (KR)

( * ) Notice: Subject to any disclaimer, the term of this patent is extended or adjusted under 35 U.S.C. 154(b) by 48 days.

(21) Appl. No.: 16/059,205

(22) Filed: Aug. 9, 2018

(65) Prior Publication Data

US 2020/0044324 A1 Feb. 6, 2020

(30) Foreign Application Priority Data

Aug. 1, 2018 (KR) ..... 10-2018-0090039

(51) Int. Cl.

| | |
|---|---|
| ***H01Q 1/28*** | (2006.01) |
| ***H01Q 21/06*** | (2006.01) |
| ***H01Q 21/29*** | (2006.01) |
| ***H01Q 21/00*** | (2006.01) |

(52) U.S. Cl.

CPC ..... *H01Q 1/282* (2013.01); *H01Q 21/0025* (2013.01); *H01Q 21/061* (2013.01); *H01Q 21/293* (2013.01)

(58) Field of Classification Search

CPC .. H01Q 1/282; H01Q 21/061; H01Q 21/0025; H01Q 21/293

See application file for complete search history.

(56) References Cited

U.S. PATENT DOCUMENTS

| | | | | |
|---|---|---|---|---|
| 6,166,705 | A | 12/2000 | Mast et al. | 343/853 |
| 2007/0152882 | A1* | 7/2007 | Hash | H01Q 21/0087 343/700 MS |
| 2008/0316143 | A1* | 12/2008 | Chen | H01P 5/103 343/893 |

FOREIGN PATENT DOCUMENTS

| | | | |
|---|---|---|---|
| JP | 2008-172339 | A | 7/2008 |
| KR | 10-2005-0004029 | A | 1/2005 |
| KR | 10-2010-0109761 | A | 10/2010 |
| KR | 10-2012-0037763 | A | 4/2012 |
| KR | 10-1328530 | B1 | 11/2013 |
| KR | 10-2015-0055042 | A | 5/2015 |
| KR | 10-1563459 | B1 | 10/2015 |
| KR | 10-2016-0092461 | A | 8/2016 |
| KR | 10-1779593 | B1 | 9/2017 |
| KR | 10-2017-0117196 | A | 10/2017 |

OTHER PUBLICATIONS

Office Action dated Mar. 21, 2019 issued in corresponding Korean Patent Application No. 10-2018-0090039.

* cited by examiner

*Primary Examiner* — Hoang V Nguyen
(74) *Attorney, Agent, or Firm* — Ostrolenk Faber LLP

(57) ABSTRACT

The present invention relates to a tile structure of a shape-adaptive phased array antenna, and more specifically to a tile structure of a shape-adaptive phased array antenna configured to improve drag and low-observable properties of an airplane, and minimize a structural interference between adjacent tiles of the phased array antenna.

5 Claims, 4 Drawing Sheets

TILE STRUCTURE OF SHAPE-ADAPTIVE PHASED ARRAY ANTENNA

CROSS-REFERENCE TO RELATED APPLICATION

Pursuant to 35 U.S.C. § 119(a), this application claims the benefit of earlier filing date and right of priority to Korean Application No. 10-2018-0090039 filed on Aug. 1, 2018, the contents of which is incorporated by reference herein in its entirety.

BACKGROUND OF THE INVENTION

1. Field of the Invention

The present invention relates to a tile structure of a shape-adaptive phased array antenna, and more specifically, to a tile structure of a shape-adaptive phased array antenna configured to improve drag and low-observable properties of an airplane, and minimize a structural interference between adjacent tiles of the phased array antenna.

2. Background of the Invention

Currently, a radar system is considered as a kind of weapon system due to a plurality of complex functions provided therein. Therefore, in order to implement various functions in one radar system, the radar system is made to be highly compact and smaller.

According to the trend of such a radar system, a transceiver module, which is a core component of the radar system, is also being made to be highly compact, smaller and lighter. As the transceiver module is made to be smaller, a scheme of the transceiver module is also being changed.

A manual transceiver module, which is driven in such a way that an output power radiated from a plurality of radiating elements using a traditional traveling wave tube (TWT), or Klystron, etc. is distributed, and then beam steering and beam width are changed through phase control by a single high-output transmitter, has gradually developed into an active transceiver module form, which is driven in such a way that a plurality of transceiver modules are connected with each other for each radiating element, and beam steering and beam width are changed through phase control by transmitters and digital attenuators included in semiconductor amplifiers, etc.

As compared with the manual transceiver module, since the active transceiver module not only has physical advantages but also can be driven with a low power, the above-described active transceiver module form has been receiving more and more attention in recent years.

A typical active array radar includes hundreds to thousands of transceiver modules. Thus, costs, weight and volume of the transceiver modules are important considerations when developing an entire radar system. To increase an output power of the transceiver module while decreasing the above-described factors and reduce a noise factor, various researches are actively underway.

A concept of packaging the transceiver module is the most crucial element in reducing these three factors. Particularly, in a case of an airborne radar which is subjected to severe physical restrictions such as a weight and volume, a tile-type transceiver module structure that can be applied to a curved surface is receiving more attention than a conventional brick-type structure.

A brick-type phased array antenna is a form in which transmission/reception signals are implemented in a parallel direction on the same plane as a system module, and a tile-type phased array antenna is a form which is implemented by separately mounting elements on a plurality of substrates, and laminating the substrates having the elements mounted thereon with each other.

On the other hand, the tile-type structure having the same scale is more difficult to utilize when implementing the phased array antenna than the brick-type structure. However, since the tile-type structure can allow the antenna to be smaller and lighter, it is more suitable as a communication antenna for an aircraft than the brick-type structure.

The tile structure of a conventional phased array antenna has a rectangular shape, which is a structure to facilitate an implementation of a planar array. However, when arranging the antenna in a curved surface structure to adapt a shape, a structural interference occurs between the tiles.

In order to prevent an occurrence of the structural interference, it is necessary that the tiles having a rectangular shape are arranged to be spaced apart from each other based on a lower surface, and consequently resulting in a large separation interval in an arrangement of the antenna. Thereby, the active phased array antenna exhibits a degradation in performance such as a reduction in an electrical beam steering performance, an increase in side-lobes of a beam pattern, and the like.

Therefore, in order to implement a shape-adaptive antenna in a wide curved surface region of the aircraft, the tile structure of a shape-adaptive antenna needs to be improved in terms of a shape.

PRIOR ART DOCUMENT

Patent Document

Korean Patent No. 10-1563459 (Entitled "an inverted F-type array antenna having a structure for improving isolation")

SUMMARY OF THE INVENTION

In consideration of the above-mentioned circumstances, it is an object of the present invention to provide a tile structure of a shape-adaptive phased array antenna in which the tile structure is formed in a "T" shape whose lower portion is narrower than an upper portion thereof to minimize a structural interference between adjacent tiles of the phased array antenna, thereby securing continuities in an arrangement of the antenna and improving performance thereof.

In addition, another object of the present invention is to provide a tile structure of a shape-adaptive phased array antenna which is configured to change sizes of upper tiles and lower tiles, such that it is possible to apply the antenna by matching to various curved surface shapes of a structure to be disposed thereon.

In order to solve the above-described objects, according to the present invention, there is provided a tile structure of a shape-adaptive phased array antenna including: an upper tile 100 including a plurality of radiation elements 110 arranged therein; and a lower tile 200 coupled to a lower portion of the upper tile, wherein the lower tile may have a horizontal cross-sectional area which is formed to be narrower than a horizontal cross-sectional area of the upper tile.

Herein, the tile structure may have one end face which is formed in a "T" shape in a vertical direction.

In addition, the tile structure may be formed in a wide top and narrow bottom shape in which a lower end portion of the lower tile is formed so as to have a narrower width than a width of an upper end portion of the upper tile.

Further, the tile structure may be formed in a wide top and narrow bottom shape in which the lower end portion of the lower tile is formed so as to have a narrower width than a width of an upper end portion of the lower tile.

Furthermore, the tile structure may be formed so that a cross-sectional area of the lowermost end portion of the upper tile is the same as the cross-sectional area of the uppermost end portion of the lower tile.

As described above, the tile structure according to the present invention is formed in a "T" shape whose lower portion is narrower than an upper portion thereof to minimize a structural interference between the adjacent tiles of the phased array antenna, thereby securing continuities in an arrangement of the antenna and improving performance thereof.

In addition, the tile structure according to the present invention is configured to change sizes of the upper tiles and the lower tiles, such that it is possible to apply the antenna by matching to various curved surface shapes of a structure to be disposed thereon.

DETAILED DESCRIPTION OF THE INVENTION

Figure 1:
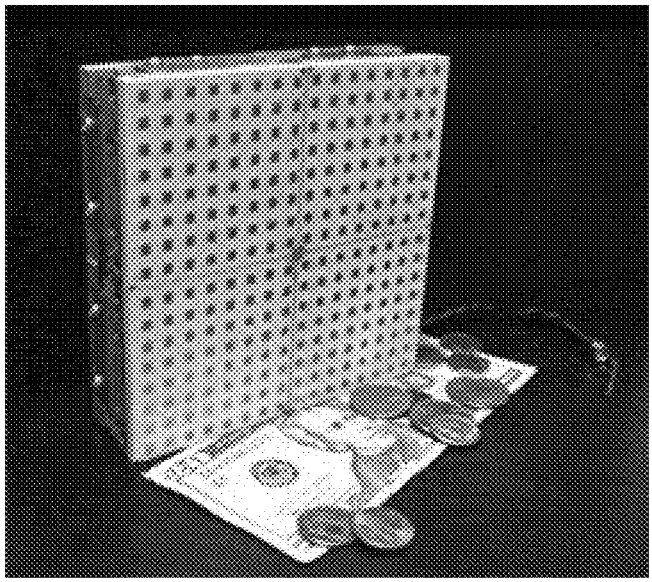
FIGS. 1 to 3 are photographs illustrating tile structures of conventional phased array antennas, which are formed in a rectangular shape.

The present invention may be altered in various ways and have various embodiments, and will be described with reference to the drawings for illustrating specific embodiments.

However, the present invention is not limited to the specific embodiments, and it will be understood by those skilled in the art that the present invention is to cover all modifications, equivalents, and alternatives falling within the spirit and scope of the present invention. Referring to the drawings, wherein like reference characters designate like or corresponding parts throughout the several views.

It will be understood that when a component is referred to as being "connected to" or "coupled to" another component, it can be directly connected or coupled to the other component intervening another component may be present. In contrast, when a component is referred to as being "directly connected to" or "directly coupled to" another component, there is no intervening component present.

In addition, the terminology used herein is for the purpose of describing particular embodiments only and is not intended to limit the present invention thereto. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Hereinafter, the present invention will be described in detail with reference to the accompanying drawings. In describing the present invention, to facilitate overall understanding, identical reference numerals will be denoted to portions performing similar functions and operations throughout the accompanying drawings, and the identical components will not be described.

Hereinafter, preferable embodiments of the present invention will be described with reference to the accompanying drawings. Referring to the drawings, wherein like reference characters designate like or corresponding parts throughout the several views. In the embodiments of the present invention, a detailed description of publicly known functions and configurations that are judged to be able to make the purport of the present invention unnecessarily obscure will not be described.

Figure 2:
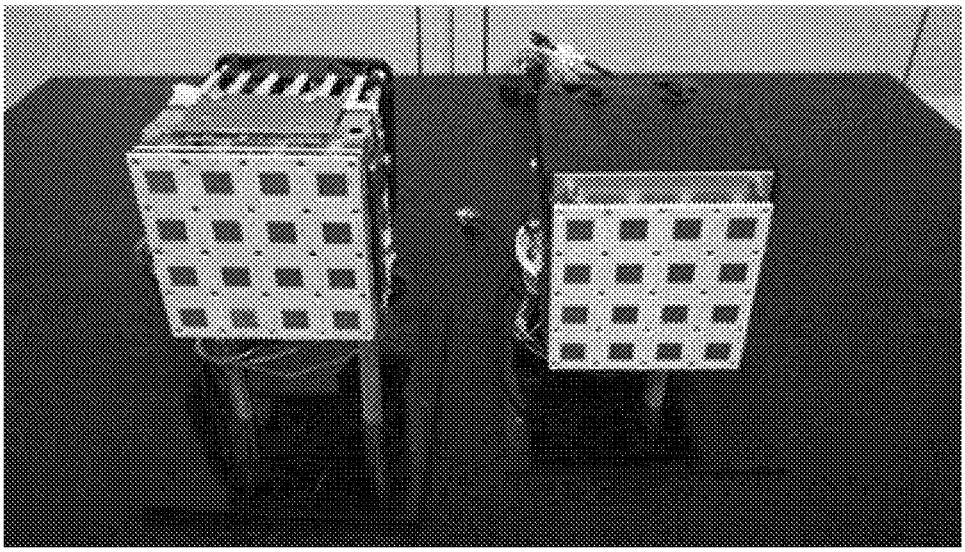
Figure 3:
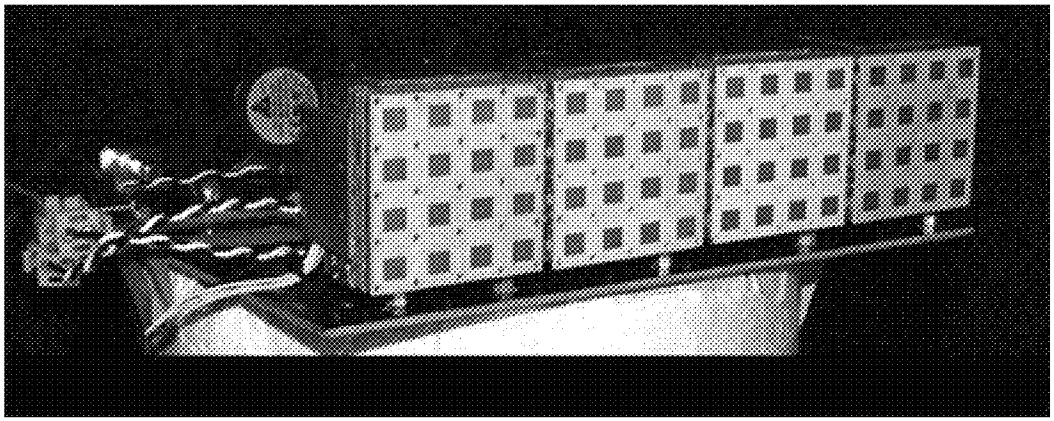
Figure 4:
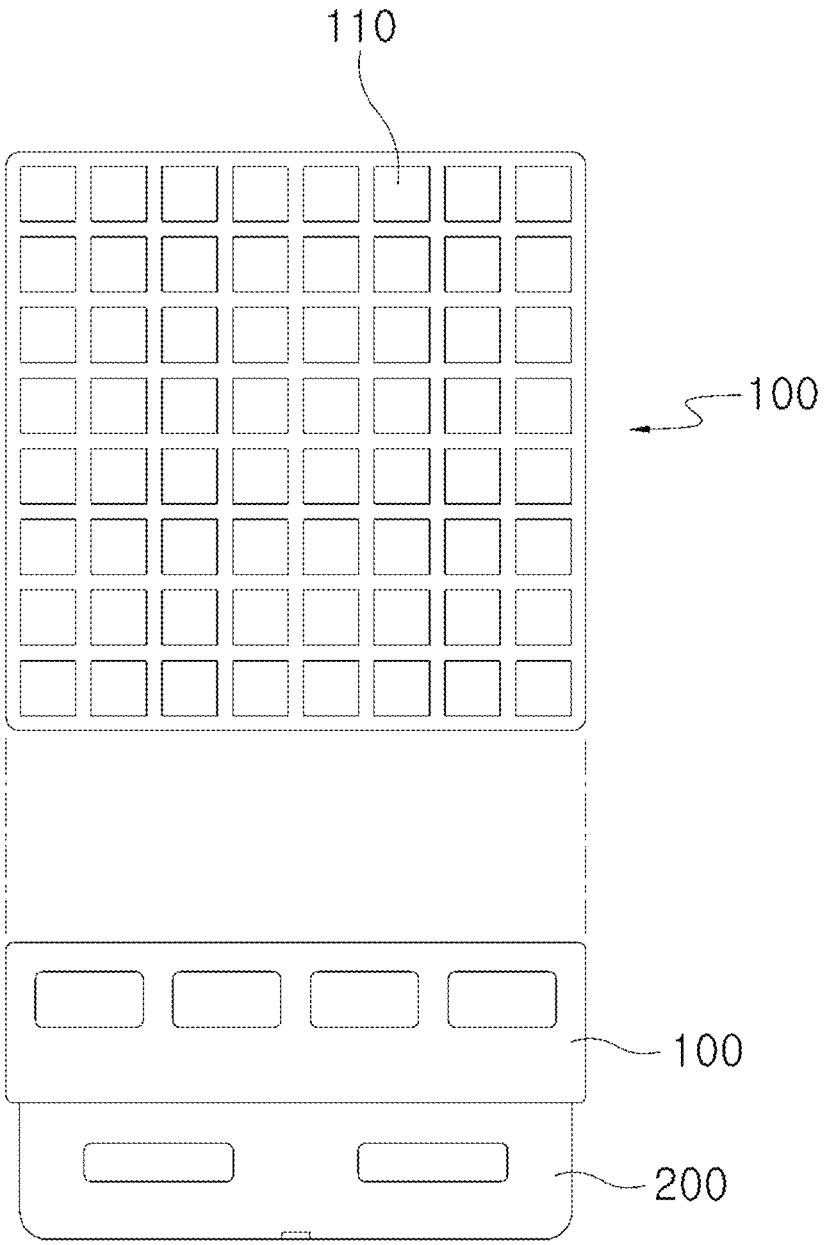
FIG. 4 is a schematic view illustrating a tile structure of a shape-adaptive phased array antenna according to a preferred embodiment of the present invention.
Figure 5:
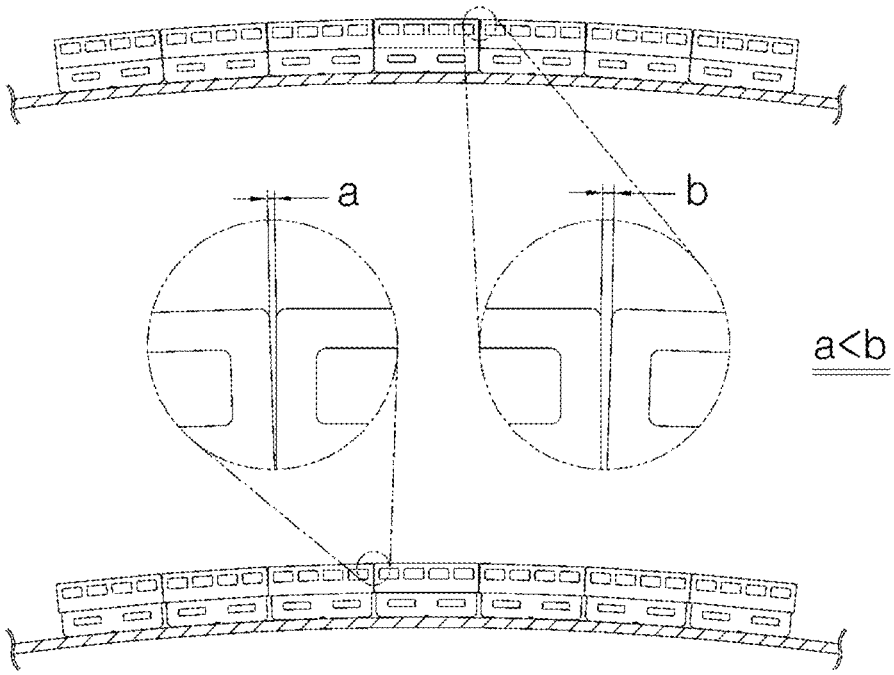
FIG. 5 is a view illustrating a tile structure of a shape-adaptive phased array antenna according to the preferred embodiment of the present invention and a tile structure of a conventional phased array antenna by comparing arrangement states therebetween.
Figure 6:
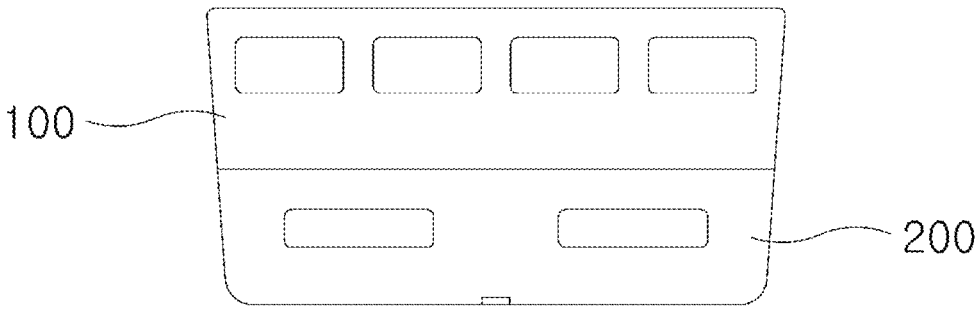
FIG. 6 is a schematic view illustrating a tile structure of a shape-adaptive phased array antenna according to another embodiment of the present invention.

FIGS. 1 to 3 are photographs illustrating tile structures of conventional phased array antennas, which are formed in a rectangular shape, FIG. 4 is a schematic view illustrating a tile structure of a shape-adaptive phased array antenna according to a preferred embodiment of the present invention, FIG. 5 is a view illustrating a tile structure of a shape-adaptive phased array antenna according to the preferred embodiment of the present invention and a tile structure of a conventional phased array antenna by comparing arrangement states therebetween, and FIG. 6 is a schematic view illustrating a tile structure of a shape-adaptive phased array antenna according to another embodiment of the present invention.

The tile structure of a shape-adaptive phased array antenna according to the preferred embodiment of the present invention generally includes an upper tile 100 and a lower tile 200, as illustrated in FIGS. 4 and 5.

At this time, the upper tile includes a plurality of radiation elements 110 arranged therein.

The above-described upper tile may include members including a substrate (not illustrated) electrically connected to the radiation elements. These members may be equally applied to the conventional phased array antenna.

In addition, the lower tile 200 is a member coupled to a lower portion of the upper tile, and may also include various members therein similar to the upper tile.

In the tile structure of the phased array antenna including the upper tile and the lower tile, as illustrated in FIG. 4, the lower tile may be formed so as to have a smaller horizontal cross-sectional area than a horizontal cross-sectional area of the upper tile.

At this time, the tile structure is characterized by having one end face which is formed in a "T" shape in a vertical direction.

Next, the tile structure of the phased array antenna according to the preferred embodiment of the present invention will be compared with a tile structure of the conventional phased array antenna.

As illustrated in FIG. 5, the tile structure of a shape-adaptive phased array antenna according to the present invention is formed in a "T" shape whose lower portion is narrower than the upper portion thereof. Therefore, it can be seen that a separation interval a between the adjacent tiles in the shape-adaptive phased array antenna according to the present invention is smaller than a separation interval b between the adjacent tiles in the tile structure of the conventional phased array antenna formed in a rectangular shape.

For example, in a case of the shape-adaptive phased array antenna according to the present invention, when assuming that an upper surface of the upper tile has a length of 84 mm, the lower tile has a length of 80 mm and they both have a height of 43 mm, a separation interval a of 1.49 mm is formed between the adjacent tiles.

On the other hand, in a case of the conventional phased array antenna formed in a rectangular shape, when assuming that the tile has a length of 84 mm and a height of 43 mm, a separation interval b of 2.73 mm is formed between the adjacent tiles.

That is, the tile structure of a shape-adaptive phased array antenna according to the present invention has a separation interval of 1.24 mm smaller than the tile structure of the conventional phased array antenna. Therefore, the shape-adaptive phased array antenna according to the present invention may have an improved electrical performance.

Further, when applying the shape-adaptive phased array antenna of the present invention to a curved surface region of an aircraft generally formed in a streamlined shape (curved surface), it is possible to dispose the antenna thereon while maintaining a minimum separation distance between the adjacent tiles, thereby improving an electrical beam steering performance, and decreasing side-lobes of a beam pattern.

As described above, the tile structure according to the present invention is formed in a "T" shape whose lower portion is narrower than the upper portion thereof to minimize a structural interference between the adjacent tiles of the phased array antenna, thereby securing continuities in an arrangement of the antenna and improving performance thereof.

In addition, the tile structure according to the present invention is configured to change sizes of the upper tiles and the lower tiles, such that it is possible to apply the antenna by matching to various curved surface shapes of a structure to be disposed thereon.

Meanwhile, as illustrated in FIG. 6, a shape-adaptive phased array antenna according to another embodiment of the present invention is characterized by being formed in a wide top and narrow bottom shape in which a lower end portion of the lower tile is formed so as to have a narrower width than a width of an upper end portion of the upper tile.

In addition, the tile structure is characterized by being formed in a wide top and narrow bottom shape in which the lower end portion of the lower tile is formed so as to have a narrower width than a width of an upper end portion of the lower tile.

Such a tile structure may be applied to a curved surface region having a relatively large curvature, and the separation interval between the adjacent tiles may be minimized.

In addition, the tile structure is characterized in that a cross-sectional area of the lowermost end portion of the upper tile is the same as the cross-sectional area of the uppermost end portion of the lower tile.

That is, by minimizing a step at a portion in which the upper tile and the lower tile are connected to each other, the tile structure is formed in an inverted trapezoidal shape as a whole, and thereby the structural interference between the tiles may be minimized and continuities of the antenna array may be secured.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Accordingly, those skilled in the art will appreciate that various modifications and other equivalent embodiments are possible from the above embodiments. Therefore, the scope of the present invention should be defined by the technical spirit of the accompanying claims.

What is claimed is:

1. A tile structure of a shape-adaptive phased array antenna comprising:

an upper tile including a plurality of radiation elements arranged therein; and a lower tile coupled to a lower portion of the upper tile, wherein the lower tile has a horizontal cross-sectional area which is formed to be narrower than a horizontal cross-sectional area of the upper tile, wherein the tile structure is formed in a wide top and narrow bottom shape in which the lower end portion of the lower tile is formed so as to have a narrower width than a width of an upper end portion of the lower tile.

2. The tile structure of a shape-adaptive phased array antenna according to claim 1, wherein the tile structure has one end face which is formed in a "T" shape in a vertical direction.

3. The tile structure of a shape-adaptive phased array antenna according to claim 1, wherein the tile structure is formed in a wide top and narrow bottom shape in which a lower end portion of the lower tile is formed so as to have a narrower width than a width of an upper end portion of the upper tile.

4. The tile structure of a shape-adaptive phased array antenna according to claim 3, wherein the tile structure is formed so that a cross-sectional area of the lowermost end portion of the upper tile is the same as the cross-sectional area of the uppermost end portion of the lower tile.

5. The tile structure of a shape-adaptive phased array antenna according to claim 1, wherein the tile structure is formed so that a cross-sectional area of the lowermost end portion of the upper tile is the same as the cross-sectional area of the uppermost end portion of the lower tile.

* * * * *